US007312775B2

(12) United States Patent
Ishiyama

(10) Patent No.: US 7,312,775 B2
(45) Date of Patent: Dec. 25, 2007

(54) ELECTRO-OPTICAL DEVICE, AND ELECTRONIC APPARATUS AND DISPLAY DRIVER IC USING THE SAME

(75) Inventor: Hisanobu Ishiyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 90 days.

(21) Appl. No.: 10/925,285

(22) Filed: Aug. 24, 2004

(65) Prior Publication Data

US 2005/0024308 A1 Feb. 3, 2005

Related U.S. Application Data

(62) Division of application No. 09/669,354, filed on Sep. 26, 2000, now Pat. No. 6,937,216.

(30) Foreign Application Priority Data

Sep. 27, 1999 (JP) ..... 11-272079

(51) Int. Cl.
*G09G 3/36* (2006.01)
*G09G 3/18* (2006.01)

(52) U.S. Cl. ..... 345/87; 345/51; 345/90; 345/103

(58) Field of Classification Search ..... 345/87, 345/98–100, 103, 104, 204, 51, 90
See application file for complete search history.

(56) References Cited

U.S. PATENT DOCUMENTS 5,420,600 A 5/1995 Strobel et al.
5,801,674 A * 9/1998 Shimizu ..... 345/98
5,852,425 A 12/1998 Bird et al.
5,956,014 A 9/1999 Kuriyama et al.
6,094,243 A 7/2000 Yasunishi

FOREIGN PATENT DOCUMENTS

EP 0-811866 12/1997
JP 53-025318 3/1978

(Continued)

OTHER PUBLICATIONS

S-MOS System, Inc., Dot Matrix LCD Driver SED1520/21, Version 1.0 (Preliminary) Oct. 1996□□www.lcd-module.de/eng/pdf/zubehoer/sed1520.pdf.*

(Continued)

*Primary Examiner*—Kee M. Tung
*Assistant Examiner*—Hau H Nguyen
(74) *Attorney, Agent, or Firm*—Hogan & Hartson LLP

(57) ABSTRACT

A liquid crystal device having a display section provided with a plurality of X electrodes and a plurality of Y electrodes, a master X driver IC and a slave X driver IC for driving the X electrodes, and a Y driver for driving the Y electrodes. The master IC has a display control signal generation section which generates a display control signal based on a signal from an external MPU and an output terminal (or input/output terminal) which outputs the display control signal. Each of the master IC and slave IC has an input terminal for receiving the display control signal from the master IC through an external wiring. This liquid crystal device can eliminate a luminance difference within the display screen driven by the master IC and the slave IC.

7 Claims, 17 Drawing Sheets

FOREIGN PATENT DOCUMENTS

| | | |
|---|---|---|
| JP | 63-266486 | 11/1988 |
| JP | 04-019617 | 1/1992 |
| JP | 07-325551 | 12/1995 |
| JP | 08-036373 | 2/1996 |
| JP | 11-015451 | 1/1999 |

OTHER PUBLICATIONS

S-MOS System, Inc., Dot Matrix LCD Driver SED 1520/21, Version 1.0 (Preliminary) Oct. 1996 http://shellyinc.com/conchips/SED1520.pdf.

* cited by examiner

ELECTRO-OPTICAL DEVICE, AND ELECTRONIC APPARATUS AND DISPLAY DRIVER IC USING THE SAME

This is a divisional of application Ser. No. 09/669,354 filed Sep. 26, 2000 now U.S. Pat. No. 6,937,216, which application is hereby incorporated by reference in its entirety.

BACKGROUND OF THE INVENTION

1. Field of the Invention

The present invention relates to an electro-optical device using an electro-optical element such as a liquid crystal, and to an electronic apparatus and a display driver IC using the electro-optical device.

2. Description of Related Art

A liquid crystal display displays a monochrome display or a gray scale display including halftone, for example.

When a liquid crystal element is used as an electro-optical element and driven passively or actively, one of a plurality of row electrodes (Y electrodes) extending in a lateral direction is selected and data signals are supplied to a plurality of column electrodes (X electrodes) extending in a longitudinal direction simultaneously, thereby driving the liquid crystal for a line at a time.

In recent years, there has been a tendency to increase the number of X electrodes to provide an extremely fine display.

In this case, it is difficult to drive all X electrodes using a single driver IC. This is because the maximum number of external terminals of an IC chip is limited to the number calculated by dividing the maximum producible size (about 20 mm to 30 mm) of the IC chip by an allowable terminal pitch (about 50 μm in the case of a COG (chip on glass)).

To deal with this problem, as shown in FIG. 10, a liquid crystal display section 600 provided with 2N pieces of X electrodes is divided into two parts in a first direction, providing two X driver ICs 610 and 620 respectively driving N pieces of X electrodes.

The X driver ICs 610 and 620 respectively supply data signals to N pieces of X electrodes based on commands and data from an MPU (microprocessor unit) (not shown). Display control signals are also generated in the X driver IC. It is sufficient that the display control signals are generated only in the X driver IC 610. In this time, the X driver 610 is called a master, and the X driver IC 620 to which the display control signals from the X driver IC 610 are input through wiring 640 is called a slave.

Display control signals necessary for a Y driver 630 are also supplied from the master X driver IC 610 through wiring 650.

In the liquid crystal display shown in FIG. 10, luminance may differ between a left screen 600A driven by the X driver IC 610 and a right screen 600B driven by the X driver IC 620 in the liquid crystal display section 600. Specifically, driving in the normally-white mode results in the right screen 600B being more whitish (pale) than the left screen 600A.

SUMMARY OF THE INVENTION

Accordingly, an objective of the present invention is to provide an electro-optical device capable of decreasing the luminance difference in a screen even if a plurality of driver ICs are used to supply data signals electrodes, and an electronic apparatus and display driver IC using the electro-optical device.

According to a first aspect of the present invention, there is provided an electro-optical device comprising:

a display section which includes a plurality of first electrodes extending in a first direction, a plurality of second electrodes extending in a second direction crossing the first direction, and electro-optical elements driven by the first and second electrodes;

a first driver which drives the first electrodes; and a second driver which drives the second electrodes, wherein the first driver has a master IC for driving a first group of the first electrodes, and at least one slave IC for driving a second group of the first electrodes;

wherein the master IC has a display control signal generation section which generates display control signals based on a signal from an external MPU; and wherein each of the master IC and the slave IC has an input terminal for inputting the display control signals generated in the control signal-generating section of the master IC through an external wiring.

The luminance difference in the conventional art is caused by a large difference in the delay of the display control signals between the master IC and the slave IC. This is because the master IC uses the display control signal generated therein, whereas the slave IC uses the display control signal input through an external wiring. The difference in the delay of the display control signals causes a difference between the voltages applied to the electrodes of the display sections of the left screen 600A and the right screen 600B in FIG. 10, thereby causing the luminance difference.

According to the present invention, the display control signal supplied from the master IC is input to the master IC and at least one slave IC through an external wiring. Therefore, the luminance difference in a screen can be decreased by reducing the difference in the signal delay in the external wiring.

In this electro-optical device of the present invention, each of the master IC and the at least one slave IC may comprise:

a display memory into which display data from the external MPU is written;

a display address circuit which assigns a display address for the display data which is read out from the display memory and displayed in the display section; and a driver which supplies a data signal based on the display data read out from the display memory to the first electrodes, and the display control signal which is input through the input terminal may be supplied to the display address circuit and the driver.

The timing of reading out the display data from the display memory and the timing of the data signal generated by the driver are both dependent upon the timing of the display control signal. The present invention can reduce the difference in these timings between the master IC and the slave IC can be reduced.

The present invention is particularly effective in the case of a gray scale display in the display section based on a pulse width modulation signal from the master IC and at least one slave IC. In this case, the display control signal generated in the display control signal generation section includes a gray scale control pulse for producing the pulse width modulation signal. The luminance difference in a screen can be reduced by decreasing the timing difference of the gray scale control pulses between the master IC and the slave IC.

According to a second aspect of the present invention, the display control signal generated in the master IC is delayed in an internal delay circuit whereas the display control signals delayed in an external wiring is used in the slave IC, thereby decreasing the difference in the delay between the display control signals used in the master IC and that used in the slave IC. This reduces the luminance difference in a screen.

In this case, if the delay in the internal delay circuit is variable, the delay can be adjusted in accordance with the signal delay depending on the external wiring to the slave IC.

According to a third aspect of the present invention, there is provided an electronic apparatus using the electro-optical device according to the above invention.

According to a fourth aspect of the present invention, there is provided a display driver IC used for the X driver of the above electro-optical device.

DETAILED DESCRIPTION OF THE PREFERRED EMBODIMENTS

Embodiments of the present invention will be described with reference to drawings.

First Embodiment

FIGS. 1 to 7 show a liquid crystal device according to a first embodiment of the present invention.

(Outline of Liquid Crystal Device)

Figure 1:
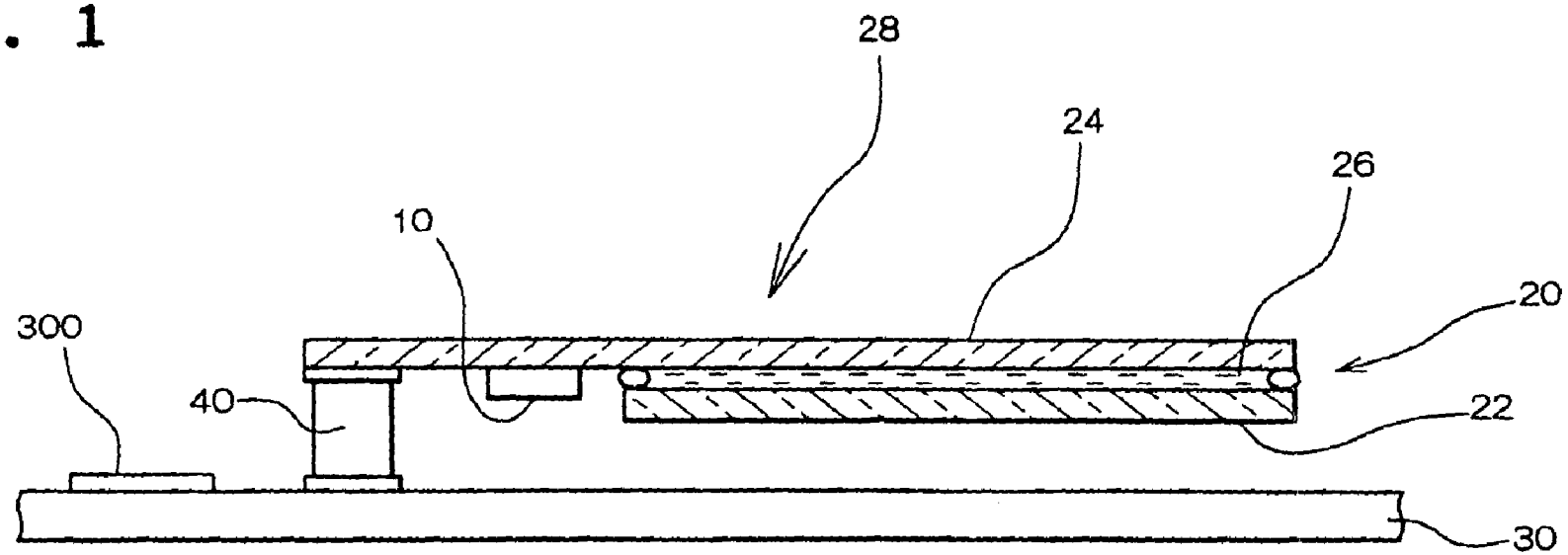
FIG. 1 is a cross section schematically showing a liquid crystal display according to a first embodiment of the-present invention.

FIG. 1 is a cross section schematically showing a liquid crystal device as a display unit of a portable telephone. As shown in FIG. 1, the liquid crystal device has a liquid crystal module 20 provided with a liquid crystal display driver IC 10, a printed circuit board 30 provided with an MPU 300, and a connector such as an elastic connection member (zebra rubber) 40 with a conductive section and an insulation section being formed alternately which is used to electrically connect the liquid crystal module 20 and the printed circuit board 30. A conductive section and an insulation section are alternately laminated in the elastic connection member 40 in the longitudinal direction towards the surface from the rear face in FIG. 1. Terminals of the liquid crystal module 20 and the printed circuit board 30 are electrically connected by uniformly applying pressure in the longitudinal direction of the elastic connection member 40.

The liquid crystal module 20 has a liquid crystal display section 28 formed by sealing a liquid crystal 26 as an electro-optical element between two glass substrates 22 and 24. The liquid display driver IC 10 is provided on the substrate 24 as a COG (chip on glass).

The first embodiment is an example in which the present invention is applied to a passive drive type liquid crystal device. For example, a plurality of segment electrodes (X electrodes) and a plurality of common electrodes (Y electrodes) are formed on each surface of the glass substrates 22 and 24 in the directions crossing each other (see FIG. 2). The liquid crystal display section 28 displays an image by controlling the transmittance of pixels formed on each cross portion of the X and Y electrodes using the voltage applied to the X and Y electrodes.

The present invention is not limited to the passive drive type liquid crystal device. The present invention may also be applied to an active drive type liquid crystal device using a two-terminal element such as an MIM (metal-insulation layer-metal) or a TFD (thin film diode), or a three-terminal element such as a TFT (thin film transistor).

Figure 16:
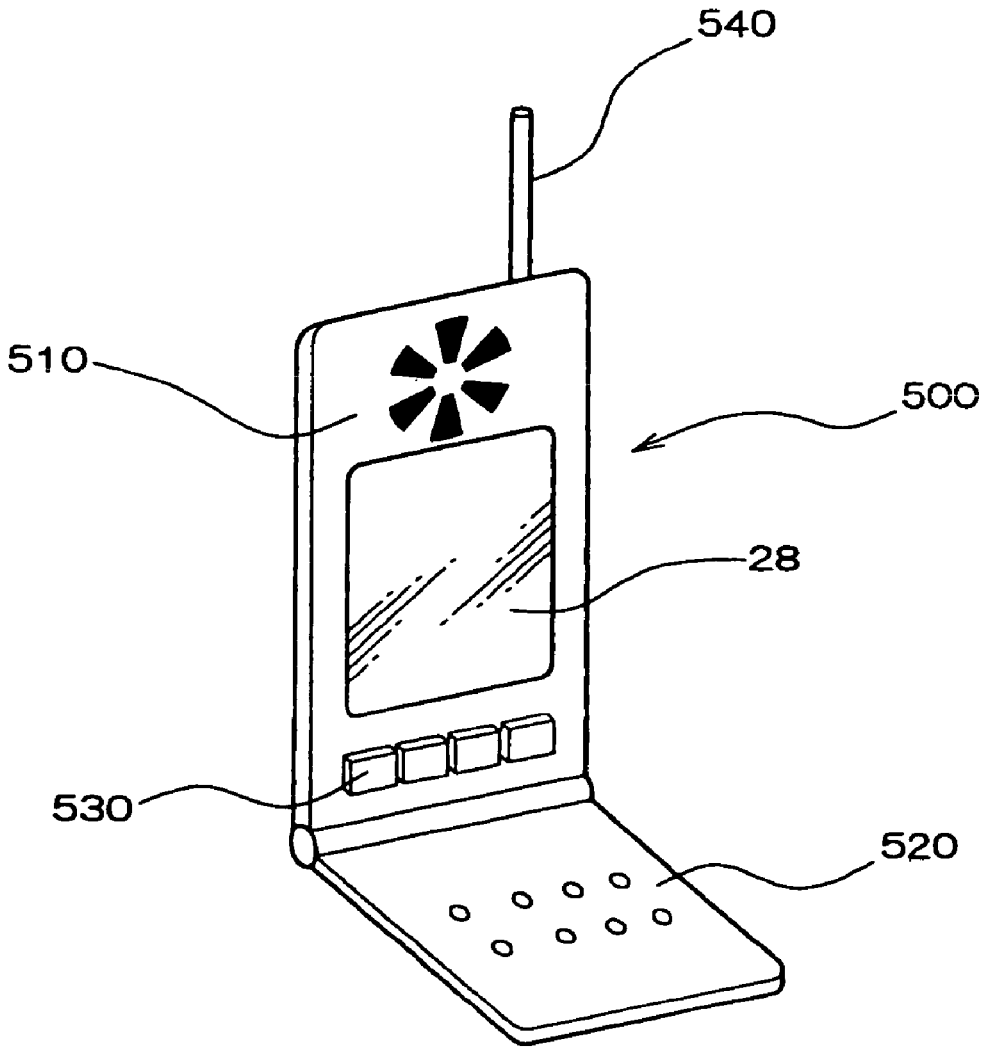
FIG. 16 is a perspective view schematically showing a portable telephone as an example of an electronic apparatus using the liquid crystal device shown in FIG. 1.

The liquid crystal module 20 is arranged in a portable telephone 500 so that the liquid crystal display section 28 is exposed as shown in FIG. 16. The portable telephone 500 has the liquid crystal display section 28, an earphone 510, a microphone 520, an operation means 530, an antenna 540, and the like. The MPU 300 outputs command data or display data to the liquid crystal module 20 based on the information received through the antenna 540 or the information input by operation on the operation means 530.

(Structure of Liquid Crystal Driver IC)

Figure 2:
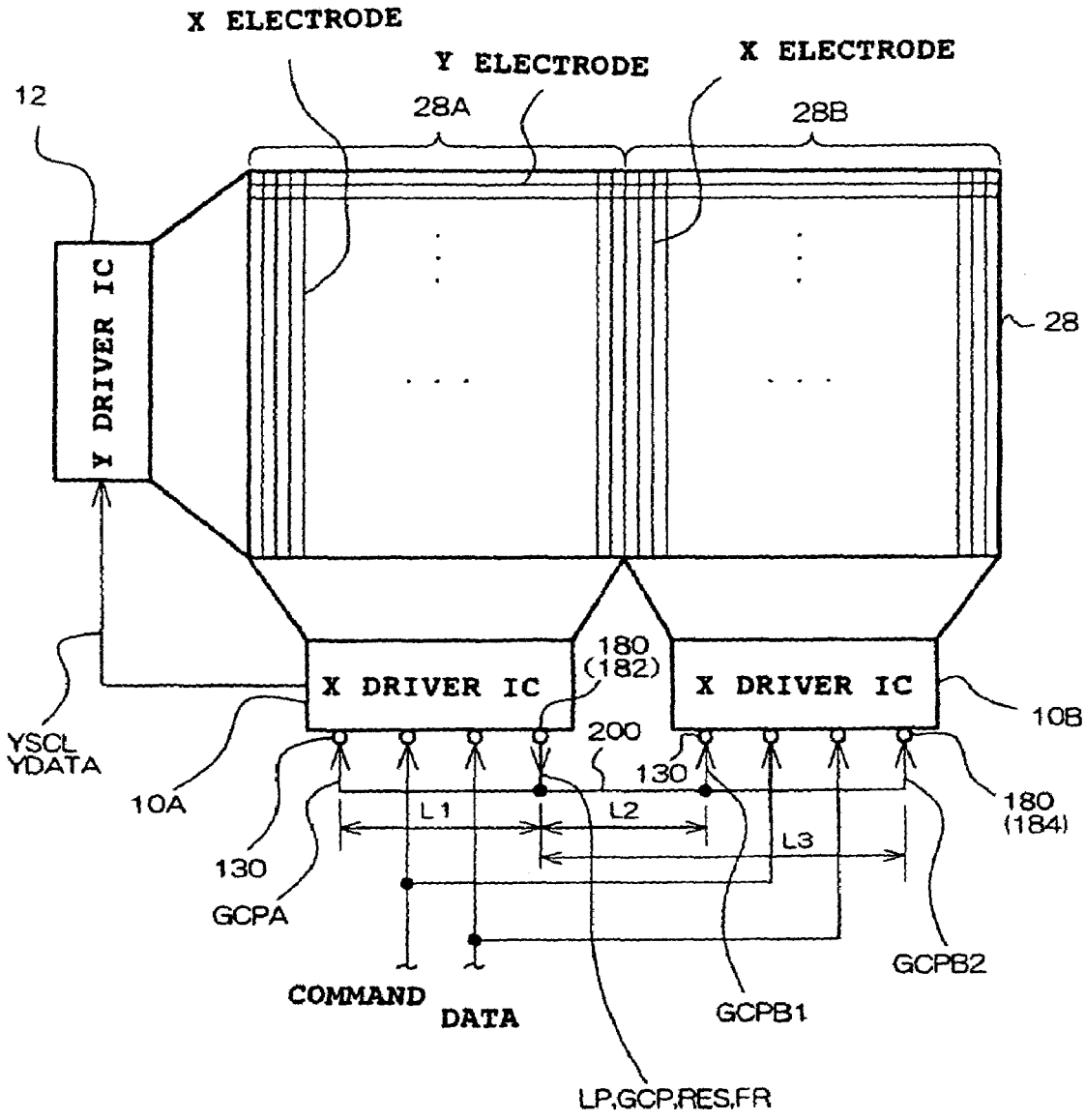
FIG. 2 shows the connection between the two X driver ICs and one Y driver IC used in the liquid crystal device of FIG. 1 and a liquid crystal display section.

FIG. 2 shows the relationship between the liquid crystal display section 28 and the liquid crystal display driver IC 10. Two X driver ICs 10A and 10B as the liquid crystal driver IC 10 and one Y driver IC 12 are provided.

Although these two X driver ICs 10A and 10B are originally the same IC, the X driver IC 10A functions as a master IC and the X driver IC 10B functions as a slave IC by the external wiring.

The X driver IC 10A drives the X electrode provided in a left screen 28A of the liquid crystal display section 28 shown in FIG. 2, and the X driver IC 10B drives the X electrode provided in a right screen 28B. Command, data, and the like output from the MPU 300 are input to the X driver ICs 10A and 10B.

The X driver IC 10A as the master outputs display control signals generated in a display control signal generation section (details will be described later) to an external wiring 200 through an output terminal 182. The display control signals are input to the X driver IC 10A through a first input terminal 130 and to the X driver IC 10B through the first and second input terminals 130 and 184. The X driver IC 10A as the master is designed to output display control signals for the Y driver IC 12 to the Y driver IC 12.

(Detailed Description of X Driver IC)

Figure 3:
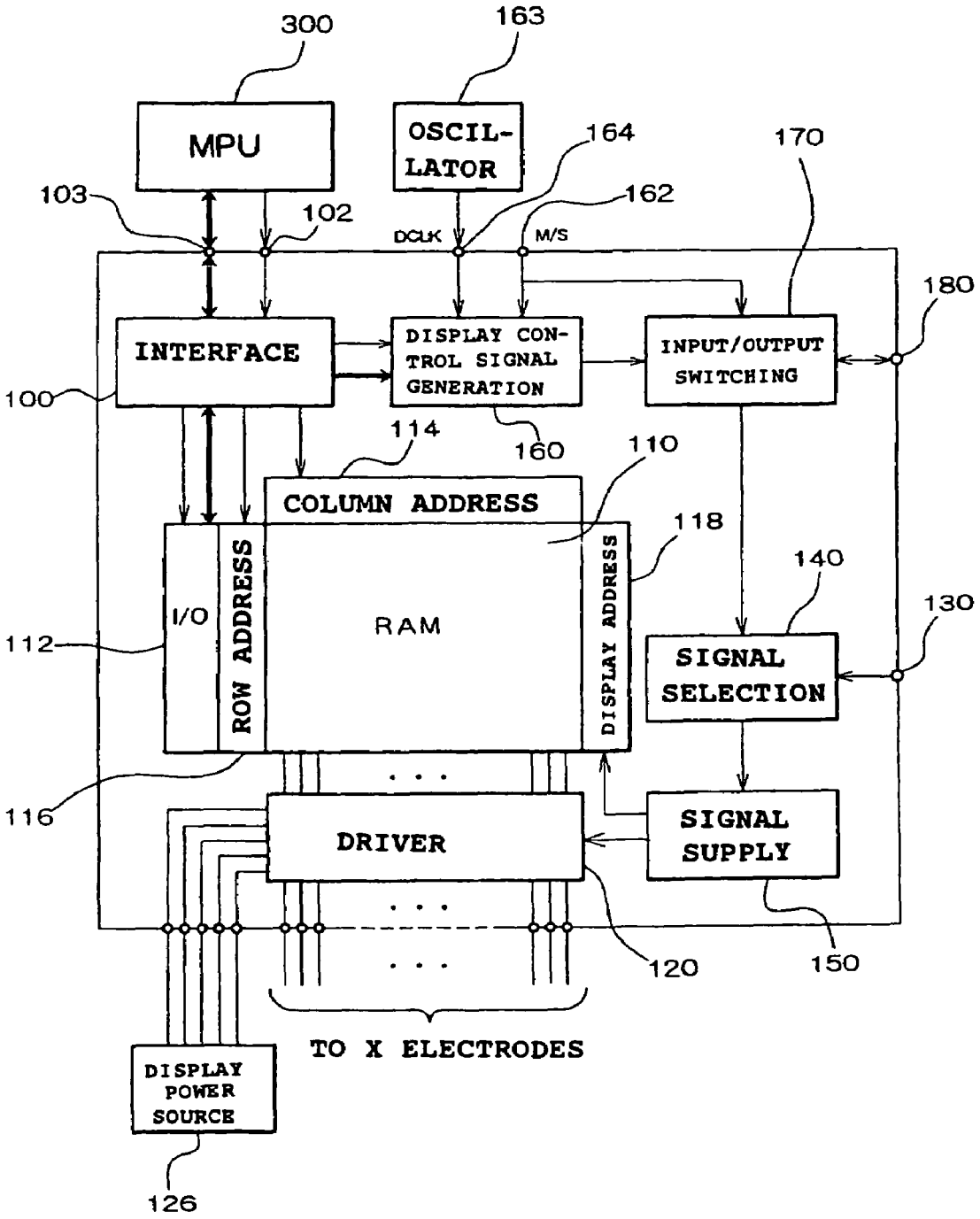
FIG. 3 is a block diagram showing a configuration common to the two X driver ICs shown in FIG. 2.

FIG. 3 shows a structure common to the X driver ICs 10A and 10B. In FIG. 3, the X driver ICs 10A and 10B have the following structure.

Commands (including write and read commands) and data (including display data and address data) from the MPU 300 are input to an interface circuit 100 in serial or parallel through terminals 102 and 103. The interface circuit 100 may have a command decoder, register, or the like.

A display memory such as a RAM 110 has at least memory elements corresponding to the number of pixels provided in the screen 28A or 28B shown in FIG. 2. The display data output from the MPU 300 through the interface circuit 100 and an I/O buffer 112 is written into the RAM 110 according to the address data output from a column address circuit 114 and a row address circuit 116 based on the write command from the MPU 300. The MPU 300 may read out the display data written into the RAM 110. The display data is read out from the RAM 110 according to the address data from the column address circuit 114 and the row address circuit 116 based on the read command from the MPU 300.

When the display is driven based on the display data written into the RAM 110, the display data of one line in the RAM 110 is read out and supplied to a driver 120 based on the address signal assigning one line, and output from a display address circuit 118.

The display control signals are needed in view of the operations of the display address circuit 118 and the driver 120. As examples of the display control signals, a latch pulse LP, reset signal RES, gray scale control pulse GCP, and polar-inversion signal FR shown in FIG. 4 can be given. These display control signals generated in a display control signal generation section 160 of the X driver 10A, as described later, are output to the outside through an input/output terminal 180 (output terminal 182 shown in FIG. 6). The display control signals are then input to the X driver IC 10A through the wiring 200 and first input terminal 130 shown in FIG. 2. The display control signals are input to the X driver IC 10B as the slave through the wiring 200, first input terminal 130, and input/output terminal 180 (input terminal 184 shown in FIG. 7).

The display address circuit 118 sequentially assigns one-line read-out addresses synchronously with the latch pulse LP.

Figure 5:
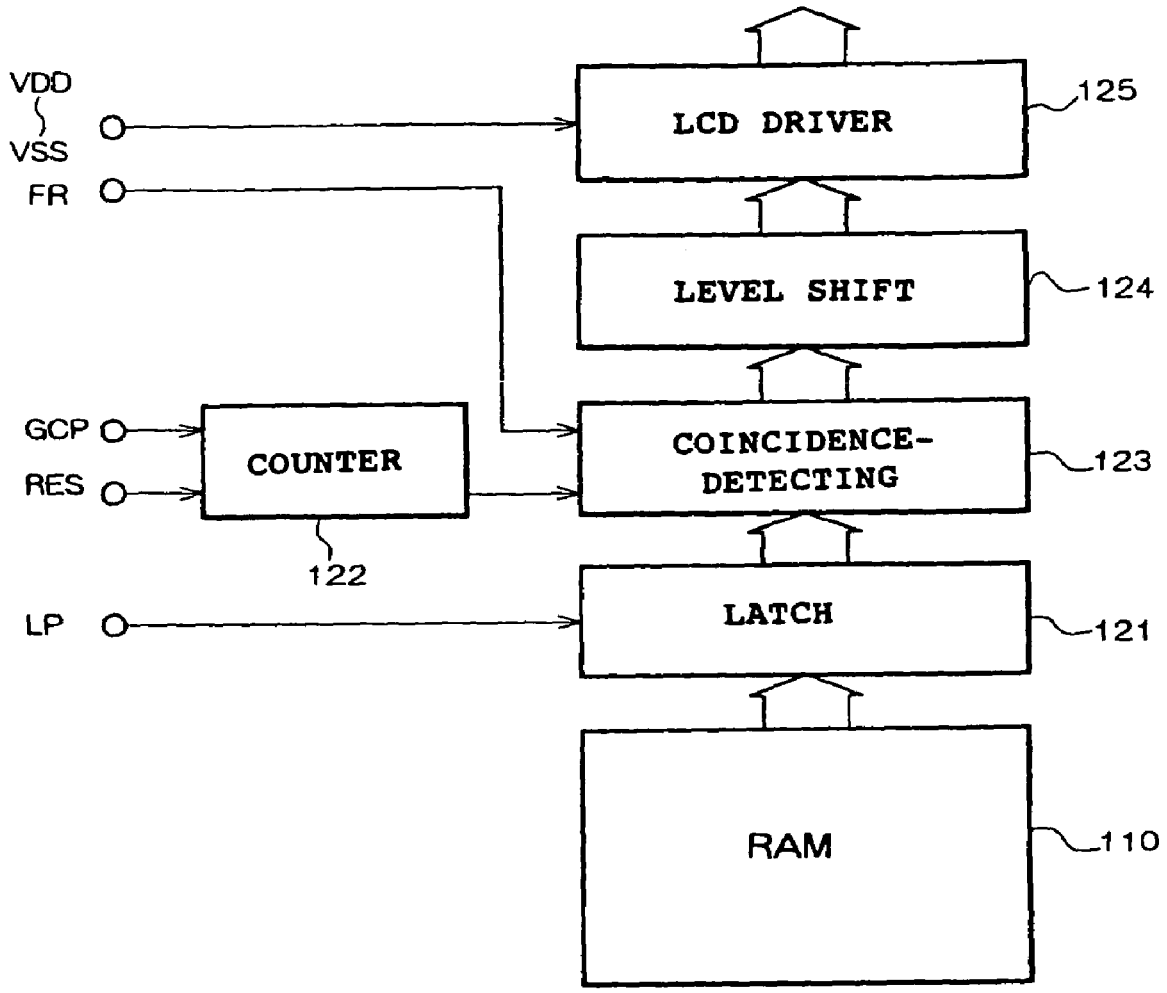
FIG. 5 is a block diagram of the driver of FIG. 3.

FIG. 5 is a block diagram showing the driver 120. In FIG. 5, the driver 120 has a latch circuit 121, a counter 122, a coincidence-detecting circuit 123, a level shifter 124, and an LCD driver 125.

Figure 4:
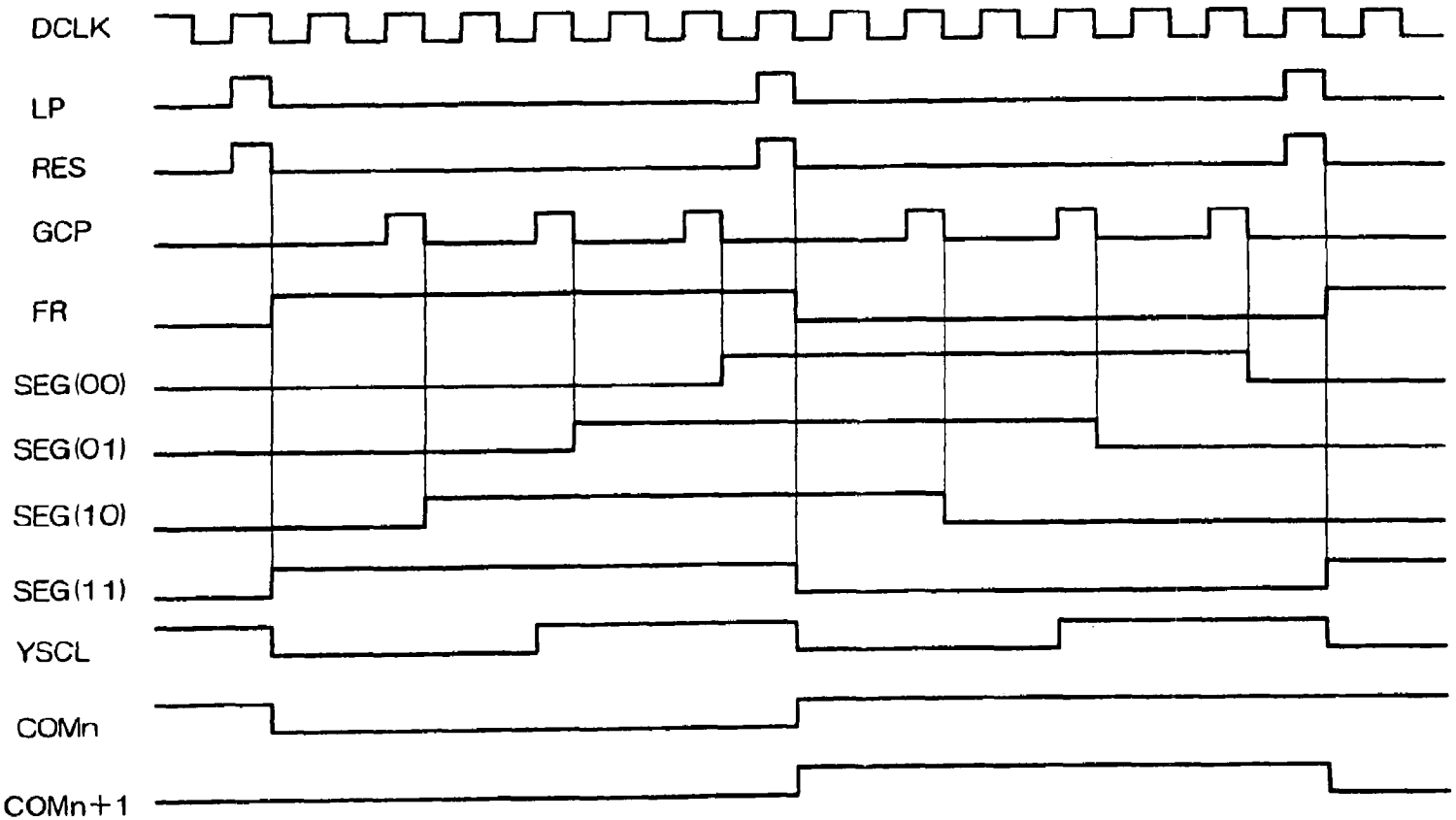
FIG. 4 is a timing chart for signals generated in the X driver IC of FIG. 3 and a Y driver IC.

The latch circuit 121 latches the one-line display data read out according to the addresses output from the display address circuit 118 synchronously with the latch pulse LP shown in FIG. 4.

When determining four gray scale values as shown in FIG. 4, the counter 122 is reset by the reset signal RES, and counts the reset signal RES as the first count value and the gray scale control pulse GCP as the second to fourth count values.

When each data value of one line output from the latch circuit 121 coincides with the count value output from the counter 122, the coincidence-detecting circuit 123 changes its output from "L" (low) to "H" (high) or from "H" to "L" based on the logic of the polar-inversion signal FR.

FIG. 4 shows segment data SEG (00) to SEG (11) corresponding to four gray scale values during positive polar driving and negative polar driving in the case of performing polar inversion for each line. Since the effective value of the voltage applied to the liquid crystal of the pixels driven based on the segment data SEG(00) becomes a minimum, the pixels are displayed as white in the normally-white mode driving. Similarly, the pixels are displayed as half tone in the case of the segment data SEG(01) and SEG (10), and as black in the case of the segment data SEG (11). When the polar-inversion signal FR is "H", four types of the gray scale values SEG (00) to SEG (11) output from the coincidence-detecting circuit 123 change from "L" to "H" corresponding to each gray scale value at the time of falling of the reset pulse RES or gray scale control pulse GCP, as shown in FIG. 4. When the polar-inversion signal FR is "L", four types of the gray scale values SEG (00) to SEG (11) output from the coincidence-detecting circuit 123 change from "H" to "L", as shown in FIG. 4.

The level shifter 124 shifts the output level of the coincidence-detecting circuit 123. The voltage required for driving the liquid crystal is supplied to the segment electrodes (X electrodes) by the LCD driver 125 based on the voltage supplied from a display power source 126.

As shown in FIG. 2, signals YSCL and YDATA are input to the Y driver IC 12 from the master X driver IC 10A. The signal YSCL is synchronized with one horizontal scanning period (selection period) shown in FIG. 4, and the signal YDATA is data indicating the top of one line. COMn and COMn+1 shown in FIG. 4 show the waveforms of the signals supplied to nth and (n+1)th common electrodes (Y electrodes) shown in FIG. 2 through the Y driver IC 12.

Figure 11:
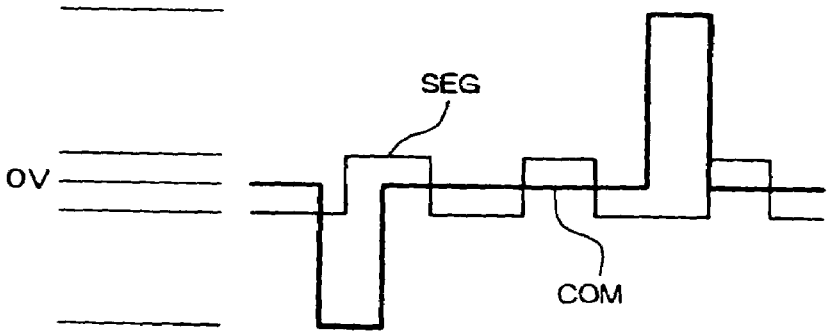
FIG. 11 shows a drive waveform used for principle driving in a passive drive type liquid crystal device.
Figure 12:
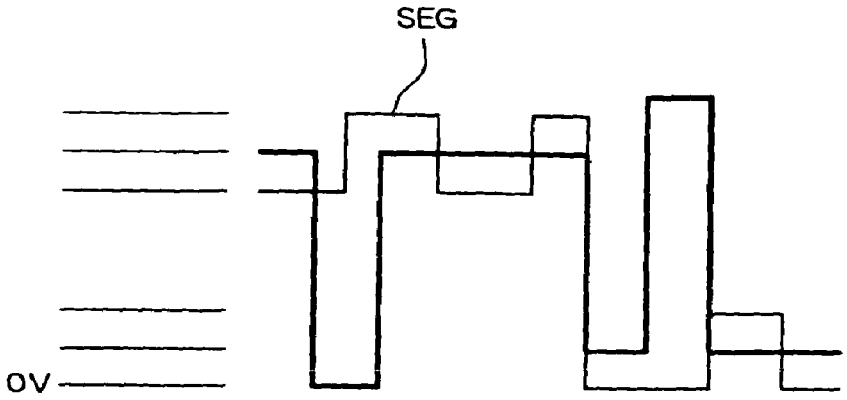
FIG. 12 shows another drive waveform used in a passive drive type liquid crystal device.

FIGS. 11 and 12 show a drive waveform SEG supplied to the X electrodes from the X driver IC 10A or 10B and a drive waveform COM supplied to the Y electrodes from the Y driver IC 12.

FIG. 11 shows the drive waveform SEG for the segment electrodes (X electrodes) and the drive waveform COM for the common electrodes (Y electrodes), which are used for principle driving in a passive drive type liquid crystal device. The drive waveforms SEG and COM have five values of positive and negative voltage levels including a middle voltage 0 V, and COM-SEG is a voltage applied to both ends of the liquid crystal.

FIG. 12 shows the drive waveform SEG for the segment electrodes (X electrodes) and the drive waveform COM for the common electrodes (Y electrodes) which are used in other driving methods in a passive drive type liquid crystal device. These drive waveforms SEG and COM have six values of positive voltage levels including a minimum voltage 0 V.

(Generation of Display Control Signal)

Figure 6:
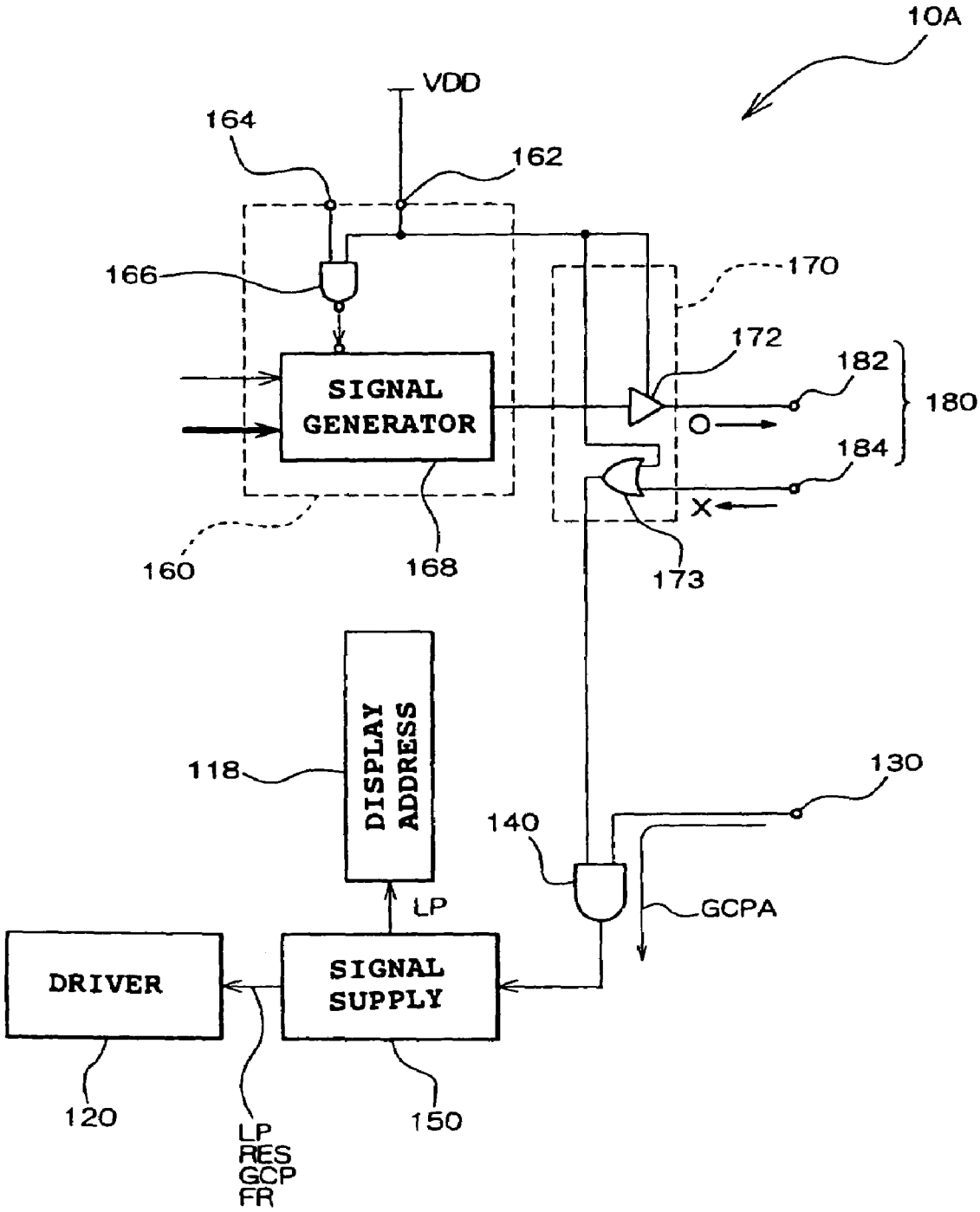
FIG. 6 is a partial block diagram of the master X driver IC shown in FIG. 2.

The display control signals LP, RES, GCP, and FR are generated only in the display control signal generation section 160 of the X driver IC 10A. FIG. 6 shows part of the X driver IC 10A as the master.

As shown in FIG. 6, the display control signal generation section 160 has a NAND-gate 166 connected to an M/S selection terminal 162 and a dot clock input terminal 164. The X driver IC 10A is designed to function as the master IC by setting the M/S selection terminal 162 to "H" externally. Therefore, a dot clock DCLK input through an oscillator 163 and the dot clock input terminal 164 passes through the NAND-gate 166 and is input to a signal generator 168. The signal generator 168 generates the display control signals LP, RES, GCP, and FR based on the data (number of the duty sets, number of polar inversions, and the like) and command (write command) output from the interface circuit 100 and the dot clock DCLK. In other words, the X driver IC 10A as the master becomes equivalent to the case where the display control signal generation section 160 is enabled by setting the M/S selection terminal 162 to "H".

Figure 7:
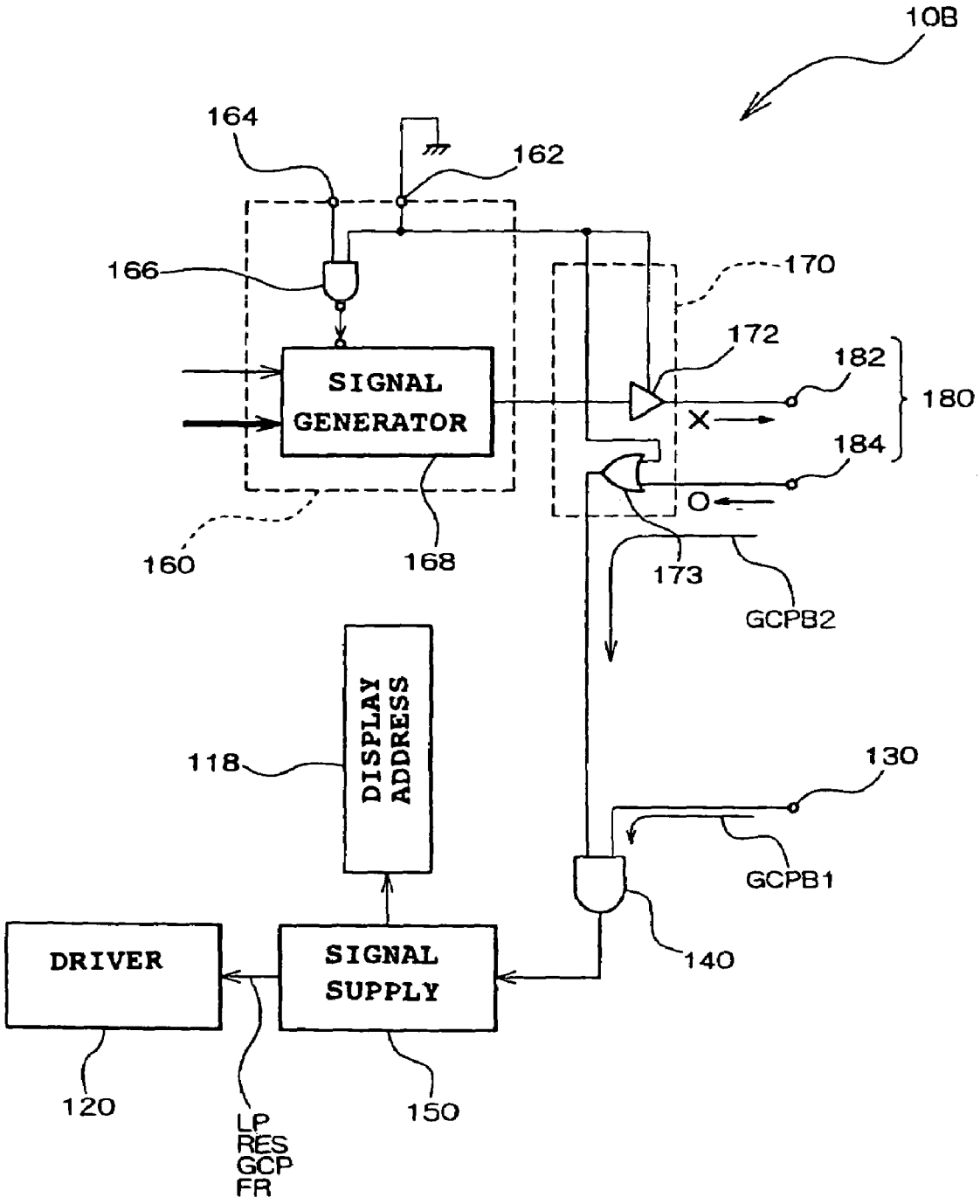
FIG. 7 is a partial block diagram of the slave X driver IC shown in FIG. 2.

In the case of the X driver IC 10B as the slave in which the M/S selection terminal 162 is set to "L", the dot clock output from the dot clock input terminal 164 does not pass through the NAND-gate 166, as shown in FIG. 7. Therefore, the display control signals LP, RES, GCP, and FR are not generated in the display control signal generation section 160 of the X driver IC 10B as the slave. Specifically, the X driver IC 10B as the slave becomes equivalent to the case where the display control signal generation section 160 is disabled by setting the M/S selection terminal 162 to "L".

(Supply of Display Control Signal)

As shown in FIGS. 6 and 7, the input/output terminal 180 shown in FIG. 3 has the output terminal 182 and the second input terminal 184 for convenience of explanation. An input/output-switching circuit 170 which switches the state of the input/output terminal 180 has a transmission gate 172 driven by the logic of the M/S selection terminal 162 and an OR-gate 173 which carries out the logical OR between the signal output from the second input terminal 184 and the signal output from the M/S selection terminal 162, as shown in FIGS. 6 and 7.

By setting the M/S selection terminal 162 to "H" in the X driver IC 10A as the master, the output terminal 182 is put in an output-possible state by the input/output-switching circuit 170, whereas the output of the OR-gate 173 is set to "H" regardless of the input from the second input terminal 184.

On the contrary, by setting the M/S selection terminal 162 to "L" in the X driver IC 10B as the slave, the logic input from the second input terminal 184 is output as is from the OR gate 173 (specifically, the second input terminal 184 is put in an input-possible state), whereas the output terminal 182 is set to a high-impedance state (output-impossible state).

In this embodiment, the X driver IC 10A as the master generates the display signals LP, RES, GCP, and RF, and each signal is not used as is in the IC 10A but output through the output terminal 182.

Next, configuration for inputting the display control signals LP, RES, GCP, and RF, which are externally output, to the X driver ICs 10A and 10B will be described with reference to FIGS. 6 and 7.

In this embodiment, an AND-gate 140 shown in FIGS. 6 and 7 constitutes a signal selection circuit 140 shown in FIG. 3. The AND-gate 140 carries out the logical AND between the display control signals input through the first input terminal 130 and the second input terminal 184.

As shown in FIG. 6, no display control signal is input from the second input terminal 184 to the X driver IC 10A set as the master IC by the M/S selection terminal 162. At this time, the logic input to the AND-gate 140 from the OR-gate 173 is set to "H". Therefore, the display control signals input from the first input terminal 130 are supplied as is to the display address circuit 118 and the driver 120 through a signal supply section 150 from the AND-gate 140.

In the X driver IC 10B set as the slave IC by the M/S selection terminal 162, the second input terminal 184 is in an input-possible state, as shown in FIG. 7. Therefore, the display control signals are supplied from the first and second input terminals 130 and 184 to the AND-gate 140, where the logical AND between the display control signals is carried out. The display control signals are then supplied to the display address circuit 118 and the driver 120 through the signal supply section 150.

(Reason for Luminance Difference in Conventional Art)

Figure 10:
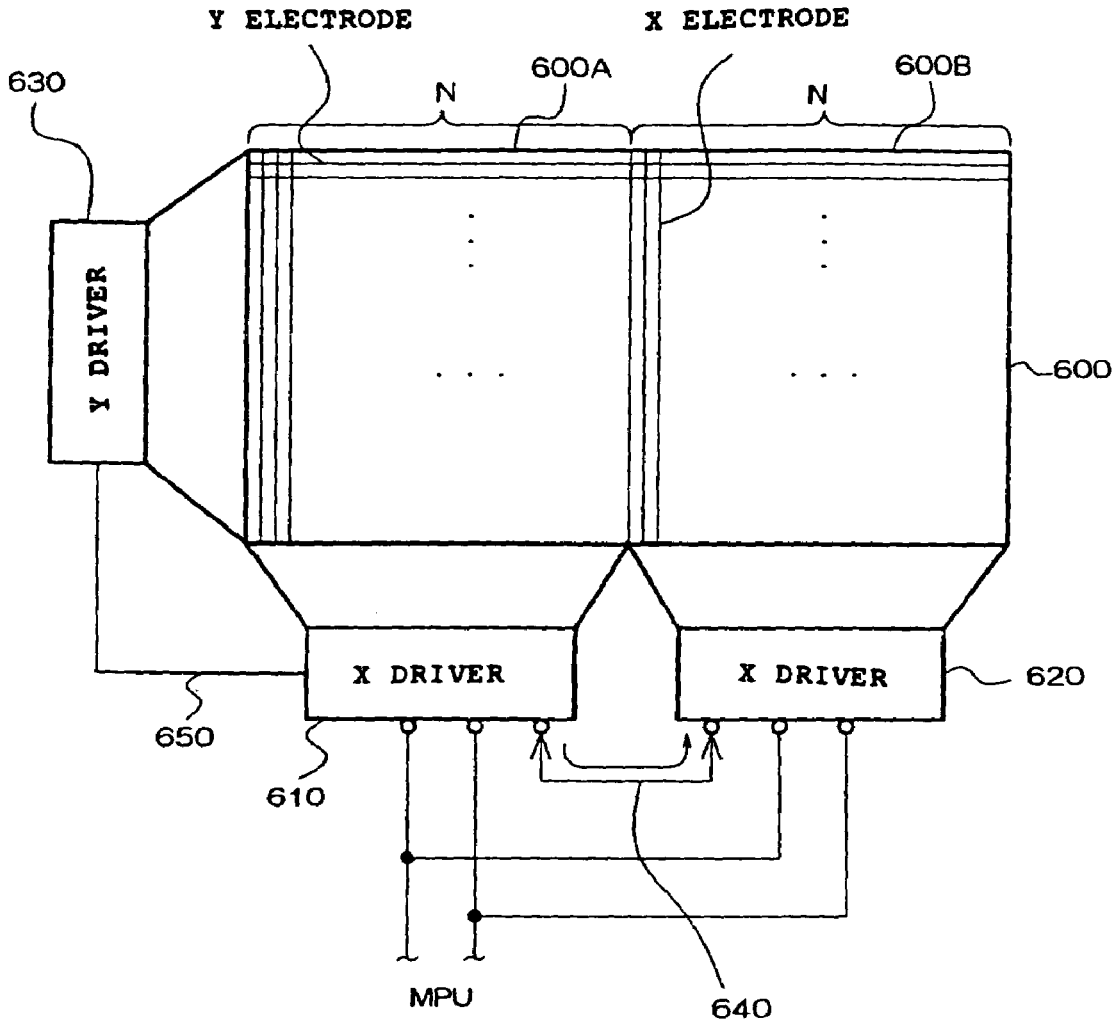
FIG. 10 shows the connection between two X driver ICs, one Y driver IC, and a liquid crystal display section used in a conventional liquid crystal device.

As shown in FIG. 10 showing a conventional art, the delay of the display control signals in a X driver IC 610 as the master is caused by the resistance and capacity of the internal wiring, whereas the delay of the display control signal in a X driver IC 620 as the slave is caused by the resistance and capacity of an external wiring 640 in addition to those of the internal wiring. For this reason, the delay of the display control signals used in the X driver IC 620 as the slave is larger than the delay of the display control signals used in the X driver IC 610 as the master.

Figure 8:
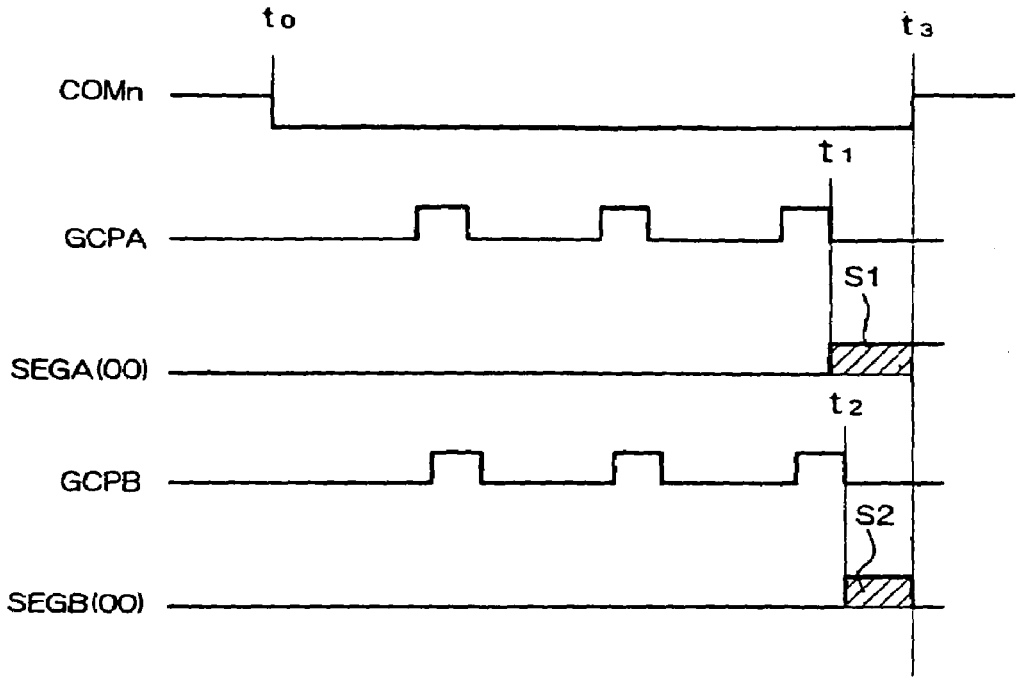
FIG. 8 is a waveform chart for describing the delay of a gray scale control pulse and an effective voltage lag caused by the delay.

FIG. 8 shows a gray scale control pulse GCP generated during one horizontal scanning period (selection period) and a signal SEG(00) obtained by the pulse GCP in each of the X driver ICs 610 and 620 of the liquid crystal device of the conventional art shown in FIG. 10.

In the X driver IC 610, the delay of a gray scale control pulse GCPA is small, whereas the delay of a gray scale control pulse GCPB is large in the X driver IC 620.

The rising edges of the signals SEGA(00) and SEGB(00) generated in the X driver ICs 610 and 620 are determined by the fall timings t1 and t2 of the corresponding gray scale control pulses GCPA and GCPB, respectively. Therefore, the rise timing t2 of the signal SEGB(00) is later than the rise timing t1 of the signal SEGA(00).

The length of one horizontal scanning period (selection period) is determined by the signal COMn supplied to the nth Y electrode from the Y driver IC 630, for example. The signal COMn is used as a signal common to both signals SEG output from both X driver ICs 610 and 620. Therefore, the start time t0 and end time t3 of one horizontal scanning period (selection period) are common to both signals SEG.

The gray scale value of the signal SEGA (00) generated in the X driver IC 610 is set based on the effective value defined by the product of the time from t1 to t3 by a voltage (area S1 shown by hatching). The gray scale value of the signal SEGB (00) generated in the X driver IC 620 is set based on the effective value defined by the product of the time from t2 to t3 by a voltage (area S2 shown by hatching).

However, it is clear that S1 is not equal to S2 and the gray scale values differ in each X driver though the gray scale values were originally the same. The luminance difference described relating to the conventional art shown in FIG. 10 arises for the above reason.

(Reason why First Embodiment Decreases Luminance Difference in Screen)

On the contrary, according to this embodiment, the luminance difference in the conventional art shown in FIG. 10 can be decreased to such an extent that the difference is not significant visually. The reason will be described below.

In FIG. 2, the length of the wiring between the output terminal 182 of the X driver IC 10A and the input terminal 130 of the X driver IC 10A is referred to as L1, and the lengths of the wiring between the output terminal 182 and the first and second input terminals 130 and 184 of the X driver IC 10B are referred to as L2 and L3. As is clear from FIG. 2, L1=L2<L3.

Figure 9:
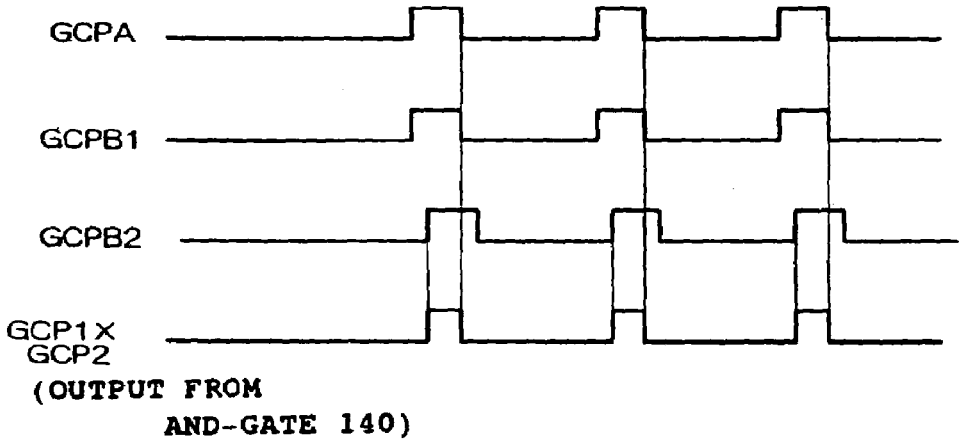
FIG. 9 is a waveform chart for describing an operation to decrease the luminance difference in a screen.

According to the above relation, the gray scale control pulses input to the first input terminal 130 of the X driver IC 10A and the first and second input terminals 130 and 184 of the X driver 10B are respectively referred to as GCPA, GCPB1, and GCPB2, as shown in FIG. 9.

As described above, the effective value of the voltage applied to the liquid crystal of the pixels depends on the rise timing of the gray scale control pulses GCPA, GCPB1, and GCPB2, as shown in FIG. 9. Therefore, use of the gray scale control pulse GCPB1 having the same rise timing as that of the gray scale control pulse GCPA used in the X driver 10A is sufficient.

In this embodiment, as shown in FIGS. 6 and 7, the AND-gate 140 is used as the selection circuit 140 shown in FIG. 3, where the logical AND between the gray scale control pulses GCPB1 and GCPB2 is carried out as shown in FIG. 9, thereby selecting the rising edge of the gray scale control pulse GCPB1.

This makes the delays of the display control signals respectively input to the X driver ICs 10A and 10B almost equal, thereby preventing a difference in luminance between the left and right screens 28A and 28B shown in FIG. 1.

The lengths L1 and L2 of the wiring 200 shown in FIG. 3 may be equal or the difference between the two lengths may be decreased. In addition, the difference in wiring delay may be decreased by changing the width or materials of the wiring 200 in each region.

Moreover, the signal selection circuit 140 which selects the logic transition state of one of two display control signals differing in delay, which are respectively input from the first and second input terminals 130 and 184, is not limited to an AND-gate. For example, the signal selection circuit 140 may be a switch which selects one of the gray scale control pulses GCPB1 and GCPB2 shown in FIG. 9. An OR-gate may be used as the signal selection circuit in order to select the falling edge of the gray scale control pulse GCPB2 in FIG. 9. There may be the case of operating synchronously with the rising edge of the display control signals such as the gray scale control pulse GCP. Namely, the signal selection circuit may be structured so that the transition state of necessary logic can be selected.

Second Embodiment

Figure 13:
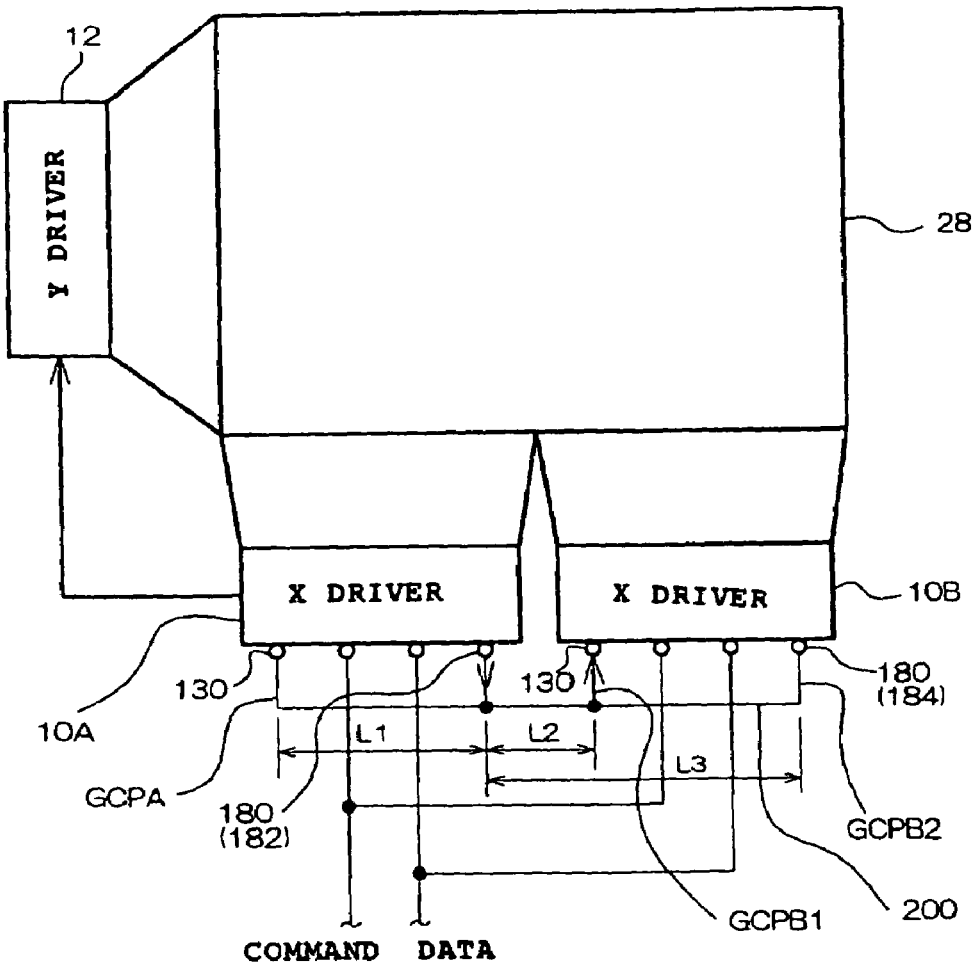
FIG. 13 shows a wiring example differing from that in FIG. 2.

FIG. 13 shows a second embodiment of the present invention in which the wiring 200 for the X driver ICs 10A and 10B differs from that in FIG. 2. In the second embodiment, the lengths of each region of the wiring 200 satisfy L2<L1<L3 and L3-L1<L1-L2. Therefore, in the case of the wiring example shown in FIG. 13, the gray scale control pulses GCPA, GCPB1, and GCPB2 become as shown in FIG. 14.

Accordingly, it is understood that the gray scale control pulse GCPB2 having fall timing close to that of the gray scale control pulse GCPA used in the X driver 10A may be used.

Figure 14:
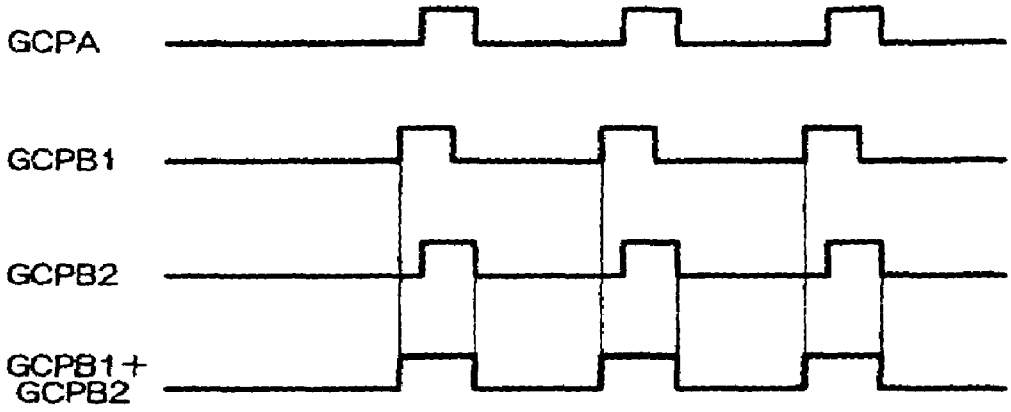
FIG. 14 is a waveform chart for describing an operation to decrease the luminance difference in a screen in the case of the wiring example of FIG. 13.

In the case shown in FIGS. 13 and 14, an OR-gate may be used as the selection circuit 140 shown in FIG. 3, where the logical OR between the gray scale control pulses GCPB1 and GCPB2 is carried out, thereby selecting the falling edge of the gray scale control pulse GCPB2 as shown in FIG. 14.

Figure 15:
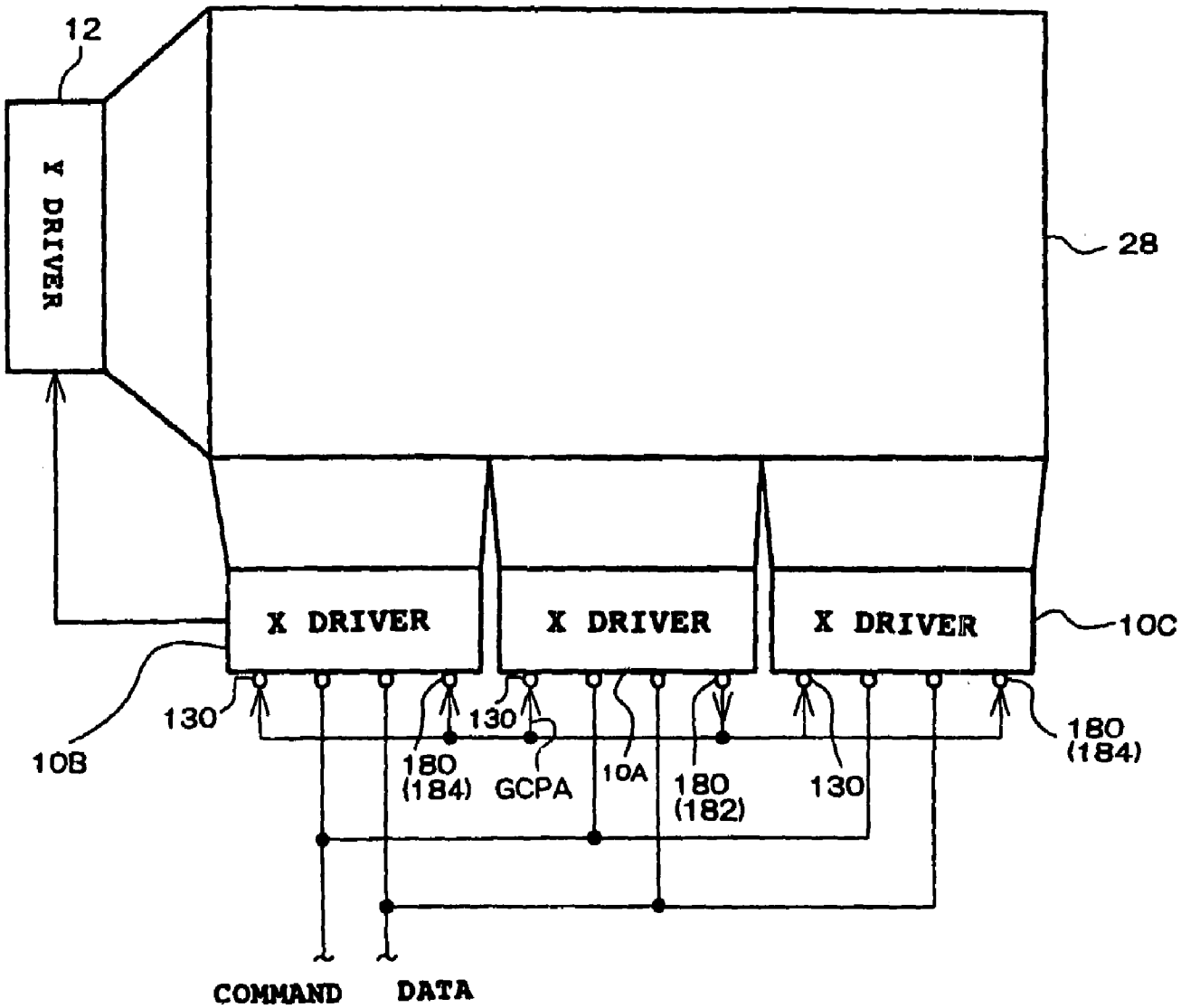
FIG. 15 is a view showing a liquid crystal device according to a second embodiment of the present invention.

FIG. 15 shows an example in which three X driver ICs 10A, 10B, and 10C are connected. The center X driver IC 10A may be the master and both the X driver ICs 10B and 10C adjacent to the X driver IC 10A may be the slaves. In this case, the difference in the time of the falling edge between, for example, the gray scale control pulses GCP used in each of these X driver ICs 10A, 10B, and 10C becomes smaller by selecting the display control signal (including GCPB2) output from a second input terminal 184 for the X driver IC 10B and the display control signal (including GCPB1) output from the first input terminal 130 for the X driver IC 10C. This decreases the luminance difference in a screen.

In this case, an AND-gate which carries out the logical AND between the display control signals differing in delay which are output from the first and second input terminals 130 and 184 may be used as the signal selection circuit 140 in the X driver IC 10B. In the X driver IC 10C, an OR-gate may be used as the signal selection circuit 140. In order to use a common IC structure for the three X driver ICs 10A, 10B, and 10C, an AND-gate and an OR-gate may be provided to the signal selection circuit 140 so that either one of these gates or the outputs of the gates is selected by providing an external wiring.

Third Embodiment

Figure 17:
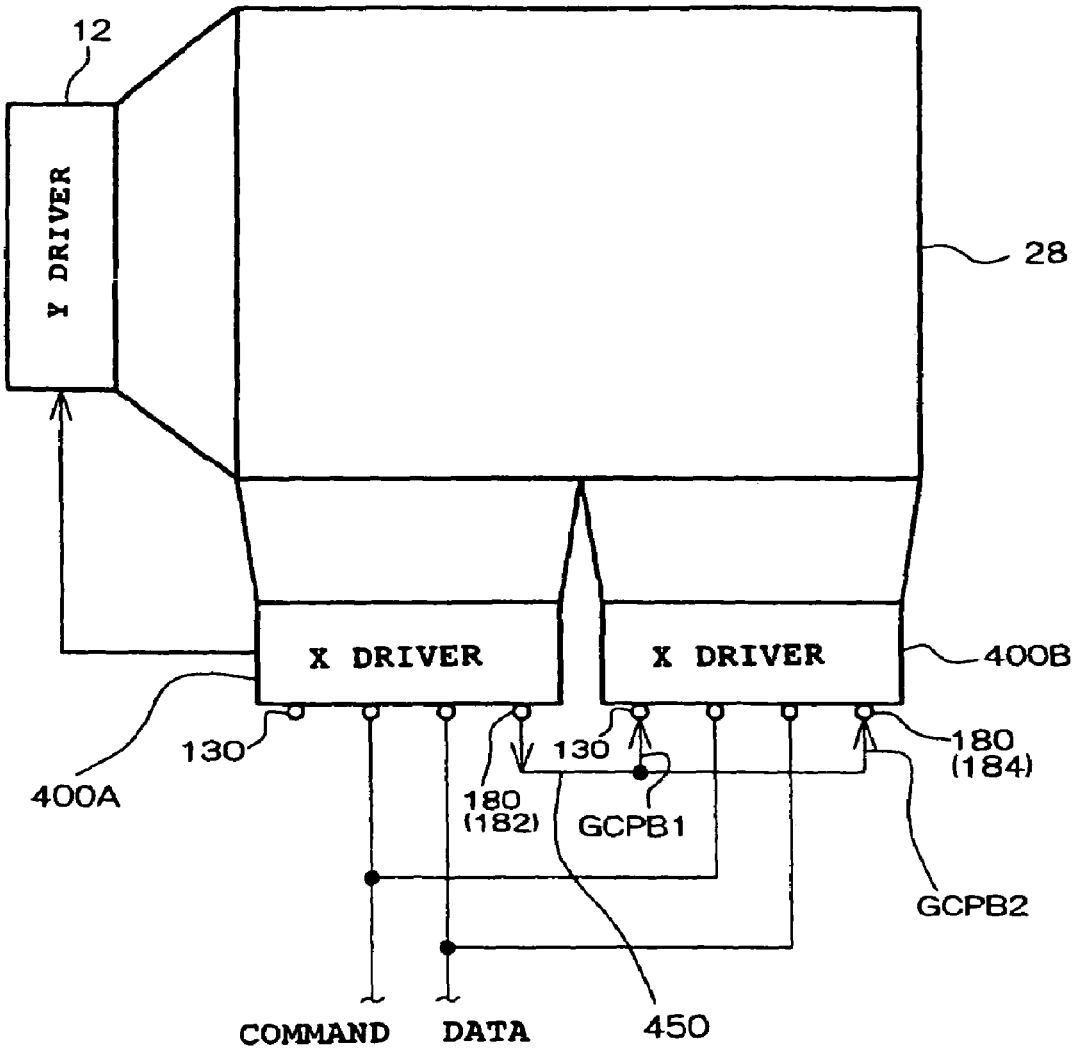
FIG. 17 is a view showing a liquid crystal device according to a third embodiment of the present invention.

FIG. 17 shows a liquid crystal device according to a third embodiment of the present invention. As shown in FIG. 17, display control signals output from an input/output terminal 180 (output terminal 182) of an X driver IC 400A as a master are input to an X driver IC 400B as a slave through a first input terminal 130 and a second input terminal 184 (input/output terminal 180) of the X driver 400B.

Figure 18:
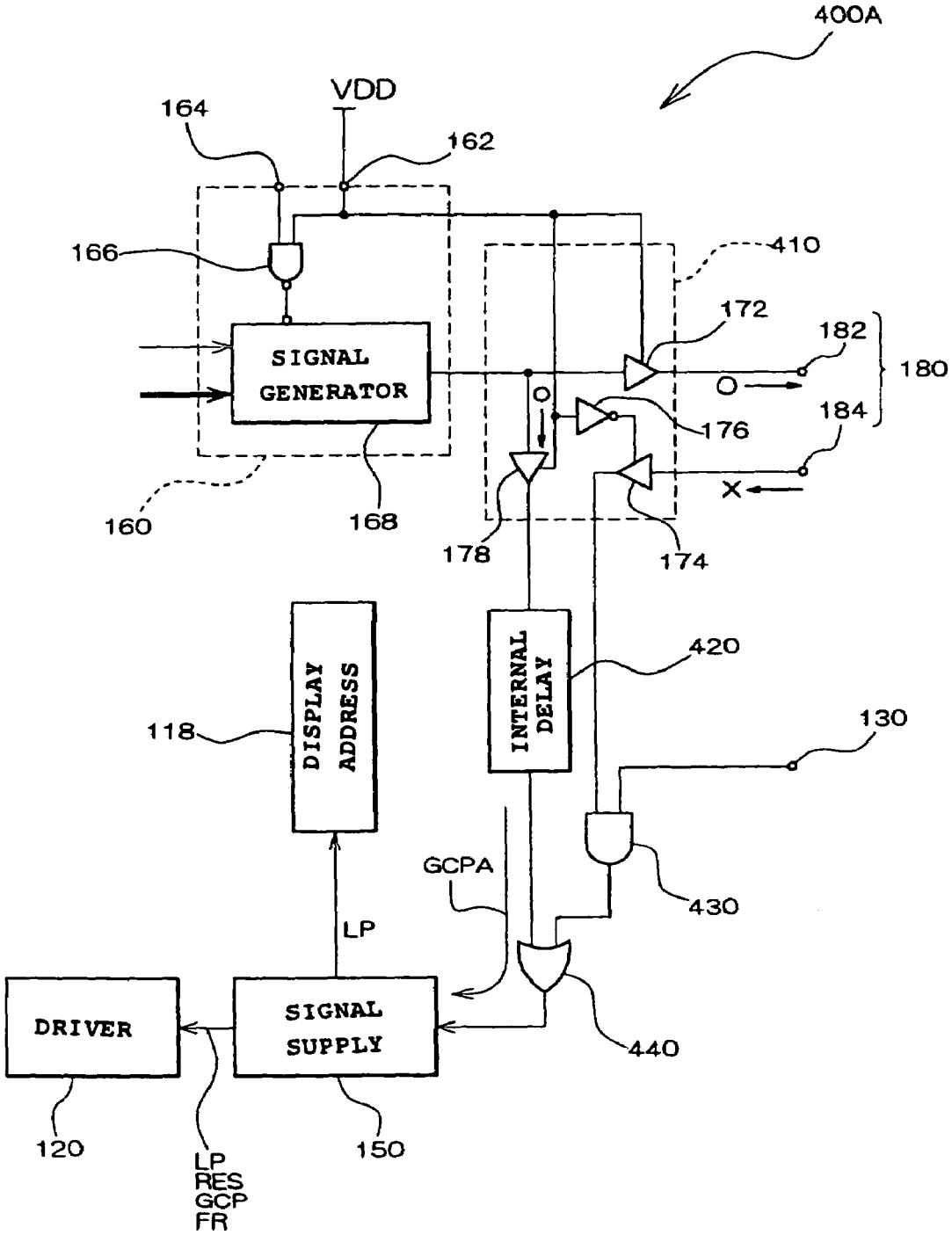
FIG. 18 is a partial block diagram of the master X driver IC shown in FIG. 17.
Figure 19:
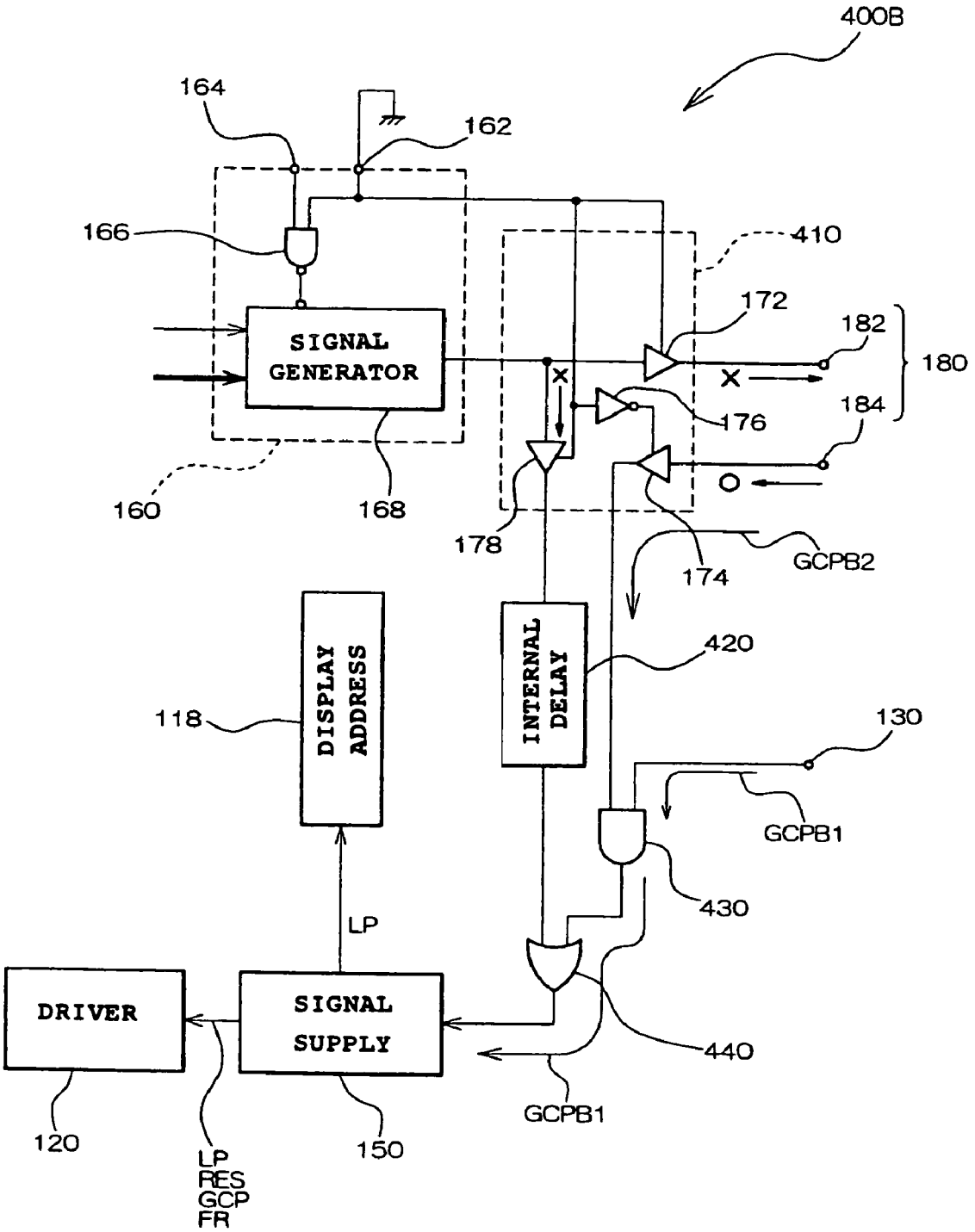
FIG. 19 is a partial block diagram of the slave X driver IC shown in FIG. 17.

FIGS. 18 and 19 show block diagrams of part of the X driver ICs 400A and 400B shown in FIG. 17. Parts having the same function as those in the block diagrams shown in FIGS. 6 and 7 are represented by the same symbols, and description thereof will be omitted.

The X driver IC 400A shown in FIG. 18 and the X driver IC 400B shown in FIG. 19 have the same structure, and differ in their function by the logic input to an M/S selection terminal 162.

These driver ICs 400A and 400B differ from those shown in FIGS. 6 and 7 in that the internal structure of an input/output-switching circuit 410 is different, an internal delay circuit 420 is provided, and an AND-gate 430 and an OR-gate 440 are provided as the signal selection circuits.

The input/output-switching circuit 410 has a second transmission gate 174 which is in a state capable of inputting the input signal output from a second input terminal 184 based on an "H" output from an inverter 176, which inverses the input logic from the M/S selection terminal 162 when a transmission gate 172 to be connected to an output terminal 182 is designated as a first transmission gate. The input/output-switching circuit 410 has a path which serves to input the display control signal output from a signal generator 168 to the internal delay circuit 420, and a third transmission gate 178 which is turned on by "H" output from the M/S selection terminal 162 in the middle of the path.

Therefore, the display control signals from the signal generator 168 are input to the output terminal 182 and the internal delay circuit 420 in the X driver IC 400A as the master. In the X driver IC 400B as the slave, the display control signals are input through the second input terminal 184 in the same manner as in the case shown in FIG. 7.

The internal delay circuit 420 serves to delay the display control signals to the same extent as or close to the wiring delay of wiring 450 extending from the output terminal 182 of the X driver IC 400A to the first input terminal 130 of the X driver IC 400B. Therefore, the display control signals (including GCPA) delayed by the internal delay circuit 420 are input to a signal supply section 150 of the X driver IC 400A as the master through the OR-gate 440.

The display control signals (including GCPB1) with a small delay and the display control signals (including GCPB2) with a large delay are input to the X driver IC 400B as the slave through the first input terminal 130 and the second input terminal 184, respectively. In this embodiment, the AND-gate 430 carries out the logical AND of between these signals. Therefore, taking the gray scale control pulse GCP as an example, the falling edge of the gray scale control pulse GCPB1 with a small delay is selected. Because the third transmission gate 178 is controlled so that the output of the internal delay circuit 420 is "L", signals from the AND-gate 430 are input to the signal supply section 150 through the OR-gate 440. This enables display control using a signal with almost the same delay as that of the gray scale control pulse GCPA used in the X driver IC 400A. Therefore, the problem of the luminance difference in a screen can be solved.

The AND-gate 430 shown in FIGS. 18 and 19 may be changed to an OR-gate or to a switch corresponding to the signal to be selected in the same manner as the signal selection circuit 140 in the first embodiment.

In the third embodiment of the present invention, the signal delay in the internal delay circuit 420 is preferably variable. A type which can control the delay so that the luminance difference in a screen is minimized while displaying an image on the screen is still more preferable.

The embodiments of the present invention are described above. The present invention is not limited to the above embodiments and various modifications may be practiced within the scope of the present invention.

Figure 20:
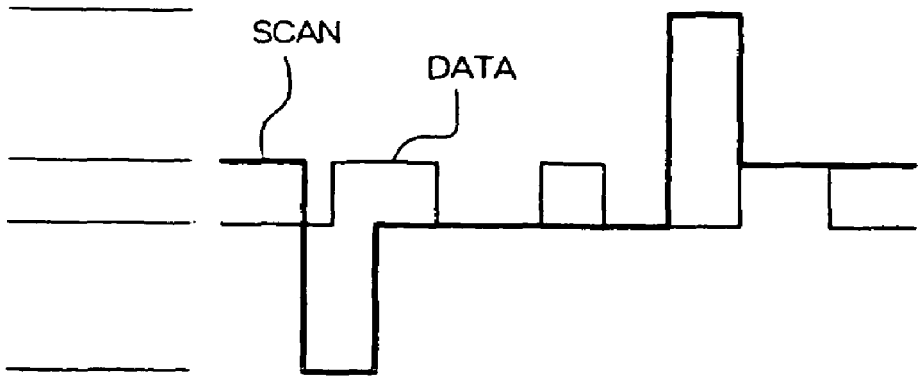
FIG. 20 shows a drive waveform used in an active drive type liquid crystal device using a TFD (thin film diode) as a switching element.

For example, when applying the present invention to a liquid crystal device, the liquid crystal display is not limited to a passive drive type liquid crystal device but may be an active drive type liquid crystal device. As an example, FIG. 20 shows a data signal (DATA) and a scanning signal (SCAN) used for gray scale display in the case of using a TFD as an active element. Moreover, the electro-optical device of the present invention is not limited to those using a liquid crystal as the electro-optical element. For example, the electro-optical device can be applied to those using an El (electroluminescence) or an MMD (micro-mirror device).

The present invention is not limited to the above types which give gray scale display using an electro-optical device. The present invention can be applied to types which use a binary display such as a black and white display. In this case, the display control signals do not include the gray scale control pulse GCP. However, when there is a difference in delay between latch pulses LP used in a plurality of X driver ICs, for example, a luminance difference in a screen is likewise caused. In this case, the luminance difference can be eliminated by applying the present invention.

Moreover, the X driver ICs used in the above embodiments have the input/output terminal 180. The input/output terminal 180 may be an output terminal. In this case, in the slave ICs 10B, 10C, and 400G, the display control signals are eventually input from only the first input terminal 130. However, use of the input/output terminal 180 is preferable inasmuch as there is the freedom of selecting one of the display control signals which are input from the first and second input terminals and differ in delay in slave ICs 10B, 10C, and 400B.

In addition to the above portable telephones, the present invention can be applied to various electronic apparatuses using an electro-optical device such as a liquid crystal device. Examples of such electronic apparatuses include personal computers, mobile computers, word processors, pagers, televisions, view finder type or monitor direct viewing type of recording devices, electronic notebooks, portable calculators, game machines, projectors, navigation devices, and terminals for point of sales (POS) system.

What is claimed is:

1. An electro-optical device comprising:

a display section which includes a plurality of first electrodes extending in a first direction, a plurality of second electrodes extending in a second direction crossing the first direction, and electro-optical elements driven by the first and second electrodes;

a first driver which drives the first electrodes; and a second driver which drives the second electrodes, wherein the first driver has a master IC for driving a first group of the first electrodes and at least one slave IC for driving a second group of the first electrodes;

wherein the master IC comprises:

a display control signal generation section which generates a display control signal based on a signal from an external MPU;

an internal delay circuit which delays the display control signal; and an output terminal which outputs the display control signal before the display control signal passes through the internal delay circuit; and wherein the at least one slave IC has an input terminal for receiving the display control signal output from the output terminal of the master IC through an external wiring.

2. The electro-optical device as defined in claim 1, wherein the signal delay in the internal delay circuit is variable.

3. An electronic apparatus comprising the electro-optical device as defined in claim 1.

4. A display driver IC which drives electro-optical elements by supplying a data signal to a plurality of electrodes, the display driver IC comprising:

an interface circuit to which address data, display data and command are input through an external MPU;

an address circuit which generates an address signal based on the address data from the interface circuit;

a display memory into which the display data from the interface circuit is written according to the address signal from the address circuit;

a display control signal generation section which generates a display control signal based on a signal from the interface circuit;

a display address circuit which generates a display address for the display data to be read out from the display memory and displayed in a display section based on the display control signal;

a driver which supplies the data signal to the plurality of electrodes based on the display data read out from the display memory and the display control signal;

a selection terminal for selecting either a master or a slave;

an output terminal for outputting the display control signal generated in the display control signal generation section;

an internal delay circuit which delays the display control signal generated in the display control signal-generating circuit;

an input terminal to which the display control signal is input from an external device; and a signal selection circuit for selecting the transition state of the logic of one of the display control signal input through the internal delay circuit and the display control signal input through the input terminal, wherein the display control signal generation section is enabled, and the display control signal generated in the display control signal generation section is output through the output terminal and input to the internal delay circuit, when the display driver IC is set as a master by the selection terminal; and wherein the display control signal generation section is disabled when the display driver IC is set as a slave by the selection terminal.

5. The display driver IC as defined in claim 4, further comprising, an input/output terminal which is provided in place of the output terminal and capable of being switched from a state of outputting the display control signal generated in the display control signal generation section to a state in which the display control signal is input from an external device and vice versa, wherein the signal selection circuit selects the transition state of the logic of one of the display control signal input through the input/output terminal, the display control signal input through the internal delay circuit, and the display control signal input through the input terminal;

wherein the display control signal is output from the input/output terminal when the display driver IC is set as a master by the selection terminal; and wherein the display control signal is input through the input/output terminal when the display driver IC is set as a slave by the selection terminal.

6. The display driver IC as defined in claim 4, wherein the signal selection circuit includes an AND circuit.

7. The display driver IC as defined in claim 4, wherein the signal selection circuit includes an OR circuit.

* * * * *